United States Patent [19]

Fuchs

[11] 4,003,506

[45] Jan. 18, 1977

[54] CASTER WITH ROTATING CLOSURE

[76] Inventor: Dieter Fuchs, 19 Westring, Dissen T.W., Germany, 4503

[22] Filed: June 2, 1975

[21] Appl. No.: 582,609

[30] Foreign Application Priority Data

June 7, 1974 Germany ..... 2427478

[52] U.S. Cl. ..... 222/555; 222/565

[51] Int. Cl.[2] ..... A47G 19/24

[58] Field of Search ..... 222/555, 565, 567, 482, 222/478, 483

[56] References Cited

UNITED STATES PATENTS

| | | | |
|---|---|---|---|
| 2,576,416 | 11/1951 | Randlett | 222/565 X |
| 3,265,255 | 8/1966 | Mitchell | 222/565 X |
| 3,297,211 | 1/1967 | Unger | 222/567 X |

FOREIGN PATENTS OR APPLICATIONS

| | | | |
|---|---|---|---|
| 1,429,235 | 10/1968 | Germany | 222/565 |

*Primary Examiner*—Robert B. Reeves
*Assistant Examiner*—David A. Scherbel

[57] ABSTRACT

A caster for pulverulent, granular or lumpy substances such as spices. The caster comprises a hollow body defining a storage chamber and at an outlet thereof is provided with a generally cylindrical wall portion defining a cavity of circular cross-section. Recess means are provided in the generally cylindrical wall portion to at least partially encompass the cavity. The caster includes a cap insert of synthetic material having a resilient portion latachably engaging the recess means to retain the cap insert on the body. A hollow cylindrical portion of the cap insert has an external diameter substantially equal to that of the cavity and is received in the cavity. A perforate plate portion of the cap insert extends across the interior of the hollow cylindrical portion and is perforate in at least one of a plurality of spatially differentiated regions of the plate portion. A cover slide is carried by the cap insert and is rotatably mounted in the interior of the hollow cylindrical portion thereof. A plate portion of the cover slide has an aperture therein and slidably contacts the perforate plate portion of the cap insert. A collar portion of the cover slide has wall members each extending substantially perpendicularly of the apertured plate portion to define therebetween a passage communicating with the aperture in the apertured plate portion. The caster includes a lid member which is adapted to be detachably mounted to the generally cylindrical wall portion of the hollow body to extend across the cavity. The lid member has an internal surface which, when the lid member is mounted on the body, is adapted to contact both the cap insert and end faces of the wall members remote from the apertured plate portion.

7 Claims, 3 Drawing Figures

A
5
6
1
3
4
2
24
22
9
17
23
18
11
13
20
15
14
8
12
10
26
16
4
7
6
3

24'
9'
22'
17'
5'
25
19
13'
11'
21
8'
4'
15'
14'
12'
4'
26'
16'
10'
7'
6'
3'

CASTER WITH ROTATING CLOSURE

BACKGROUND OF THE INVENTION

The present invention relates to a caster for pulverulent, granular or lumpy substances such as spices.

A caster of the kind referred to above is known from the German Patent Specification No. 1,429,253 and widely distributed in commerce. In this known caster, all parts, that is, the caster body, the insert unit and over-engaging lid, consist of synthetic material. In this, the plugging-in and the retention of the insert unit presents no particular difficulty. The same applies also for a modified construction of the insert unit, as it is known from the German Utility Model Specification No. 7006,873.

Difficulties in relation to the plugging-in or retention of the insert unit consisting of synthetic material arise, however, when, instead of a caster body consisting of synthetic material, one of glass is used. The different nature of the material of the insert unit on the one hand and the caster body on the other hand, as well as certain unavoidable tolerance fluctuations between the external diameter of the insert unit and the internal diameter of a caster body, consisting of glass in this case, do not permit the formation and mounting of the insert unit in the hitherto known manner.

SUMMARY OF THE INVENTION

According to the present invention, there is provided a caster for pulverulent, granular or lumpy substance such as spices. The caster comprises a hollow body defining a storage chamber and at an outlet thereof comprising a generally cylindrical wall portion defining a cavity of circular cross-section, recess means provided in the generally cylindrical wall portion to at least partially encompass the cavity, a cap insert of synthetic material and comprising a resilient portion latchably engaging the recess means to retain the cap insert on the body. A hollow cylindrical portion of the cap insert has an external diameter substantially equal to that of the cavity and is received in the cavity, a perforate plate portion of the cap insert extending at the outlet across the interior of the hollow cylindrical portion and being perforate in at least one of a plurality of spatially differentiated regions of the plate portion. A cover slide is carried by the cap insert and rotatably mounted in the interior of the hollow cylindrical portion thereof, a plate portion of the cover slide having an aperture therein and slidably contacting the perforate plate portion of the cap insert, a collar portion of the cover slide having wall members each extending substantially perpendicularly of the apertured plate portion to define therebetween a passage communicating with the aperture in the apertured plate portion. A lid member is adapted to be detachably mounted on the generally cylindrical wall portion of the hollow body to extend across the cavity and has an internal surface which, when the lid member is mounted on the body, is adapted to contact both the cap insert and end faces of the wall members remote from the apertured plate portion.

The latching connection provided between the cap insert and the caster body, which is obtainable because of the resilience of the synthetic material of the cap insert, makes possible a secure and rotationally fast mounting and retention of the insert unit comprising the cap insert and the cover slide even when the caster body consists of glass without otherwise impairing the simple plugging-in or withdrawing of the inert unit and thus, the releasability of the insert unit. Size differences between the insert unit and the caster body may thus be compensated for within a relatively wide range.

BRIEF DESCRIPTION OF THE DRAWING

Embodiments of the invention will now be more particularly described by way of example with reference to the accompanying drawing, in which.

DESCRIPTION OF THE PREFERRED EMBODIMENTS

Figures 1, 2, 3:
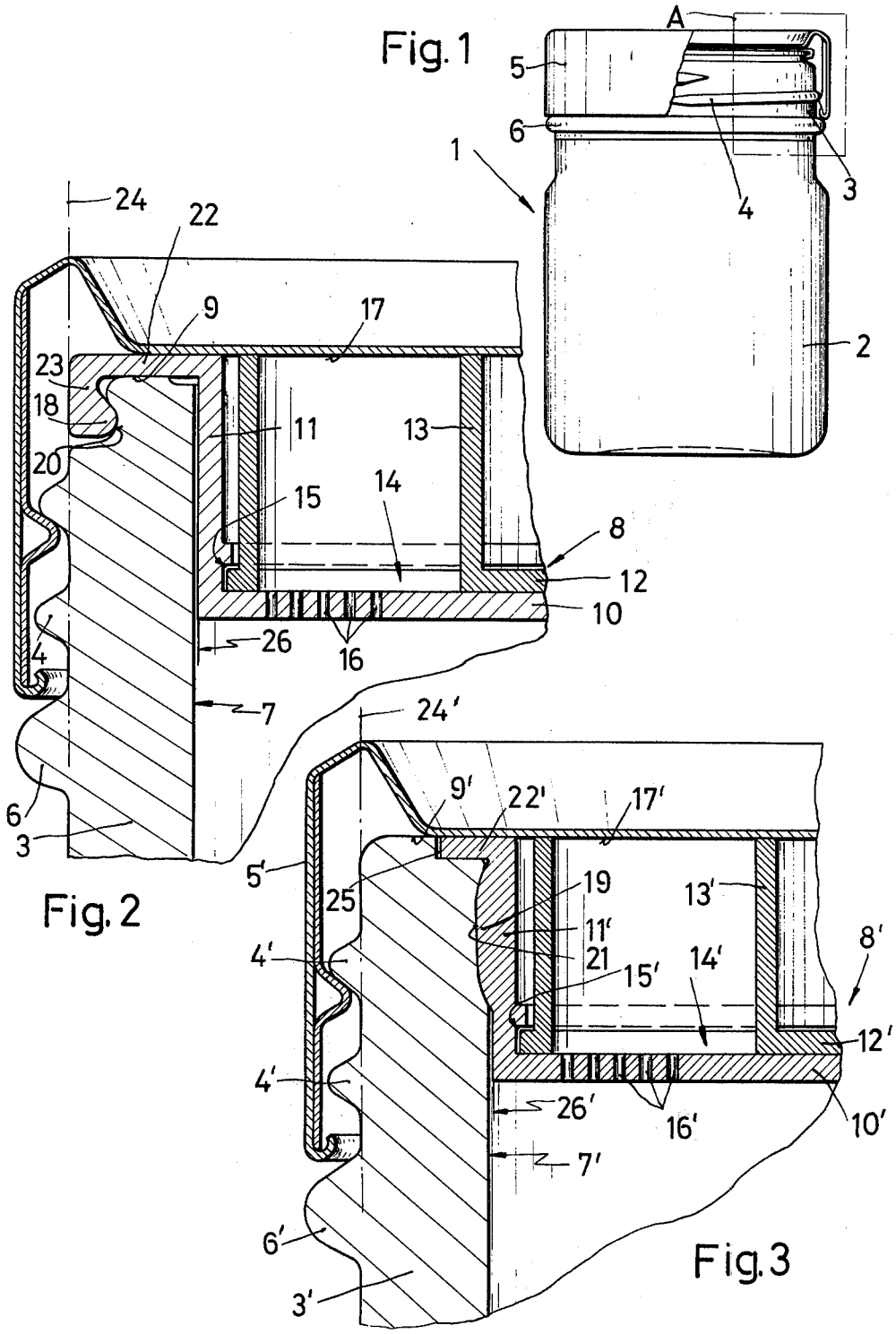
FIG. 1 is an elevational view of a caster embodying the invention and provided with a rotatable lid.
FIG. 2 is a sectional view of the region A of the caster shown in FIG. 1 in accordance with a first embodiment of the invention.
FIG. 3 is a sectional view of the region A of the caster shown in FIG. 1 in accordance with a second embodiment of the invention.

Referring now to the caster illustrated in FIGS. 1 and 2 of the accompanying drawing, the hollow caster body, which is designated generally by the reference numeral 1, is made of glass and comprises a hollow body 2 which, at an outlet thereof, is provided with a cylindrical wall portion 3 defining a cavity of circular cross-section. The portion 2 of the caster body may be of either circular or of square cross-section. As is further evident from FIG. 1, a thread element 4, which may either be circumferentially continuous or may comprise a plurality of individual sections separated from one another by circumferential gaps, is provided at the external circumference of the cylindrical wall portion 3 of the caster. The caster body is closed by a rotatable lid member 5, which is provided with a thread element cooperable with the thread element 4. The lid 5 may be made of synthetic material, of sheet metal or of any other suitable material haing some intrinsic resilience. Preferably provided at the lower end of the cylindrical wall portion 3 of the caster body 1 is a circular rib 6, which has an external diameter approximately corresponding to the external diameter of the lid 5 and which forms a protective beading for the lower edge of the lid 5.

As is evident in FIG. 2, the caster insert unit designated generally by the reference numeral 8 is arranged to extend into a recess which is disposed underneath the upper opening edge 9 in the cylindrical region 3 of the caster body 1. The diameter of the circumferential surface of the base of the caster body in the cylindrical region 3 is indicated diagramatically in FIG. 2 by the reference numeral 7. The insert unit 8 comprises a perforate plate portion in the form of a sieve plate 10, which is differently apertured in different regions and which forms the bottom wall of the insert unit 8. As shown in FIG. 2, the insert unit 8 is provided with a cap insert having a vertically extending cylindrical wall 11. A rotatably mounted cover slide 12, having an aperture 14 surrounded by an upwardly projecting collar structure 13, is disposed above the sieve plate 10. The rotary cover slide 12 is rotatably carried by the sieve plate 10 by an outer ring 15 and thus, together with the sieve plate 10, forms part of the insert unit 8. The rotary cover slide 12 is provided with a plate portion having an aperture 14 surrounded by the standing collar structure 13. The cover slide 12 may be rotated by means of special hand-grip projections (not shown), so that it selectively wholly or partially uncovers one of the perforate regions of the sieve plate 10, which is provided with respective different sets of perforations such as sieve holes 16 in different regions thereof, or completely covers such perforated regions of the sieve plate 10 with an entirely closed portion of the cover slide 12 and thereby closes off the caster. The standing collar structure 13 surrounding the aperture 14 of the rotary cover slide 12 has wall members each extending substantially perpendicularly of the apertured plate portion. End faces of these wall members remote from the apertured plate portion are adapted to contact the internal surface of the lid 5 when the latter is mounted on the hollow caster body.

The retention of the insert unit 8 of synthetic material within the bore 7 of the cylindrical wall portion 3 of the caster body of glass takes place when the insert unit 8, by means of a lip 18 (FIG. 2), is brought into latching engagement with recess means in the form of an external groove 20. The latching engagement is obtained by reason of the resilient qualities of the synthetic material of the insert unit 8.

A flange 22 (FIG. 2), which extends outwardly from the vertical cylindrical wall 11 of the insert unit 8, is provided with a downwardly bent rim 23 which, at its inner circumference, forms the lip 18. The lip 18 cooperates with an external groove 20, which is provided underneath the opening edge 9 of the caster body and in which it clampingly notches with slight elastic deformation of the extension 23 on pressing the insert unit 8 into the bore 7. The surfaces of the lip 18 and the groove 20 are so formed or adapted to one another, as is evident from FIG. 2, that the notching-in required only relatively little pressure and that, in the engaged position, a wedging at the bottom of the groove is achieved by the resilience of the material of the lip 18 and of the rim 23. The insert unit 8, which is thus retained rotationally fast on the caster body, may however be released therefrom again without difficulty, for example by inserting a lever or finger tip between the lip 18 and the lower surface of the groove 20 (FIG. 2).

The lip 18 and the external groove 20 shown in FIG. 2 may either be continuous or discontinuous in the circumferential direction. In the last mentioned case, a shape-locking rotational securing of the insert unit 8 in the caster body could be attained, but it would then require a corresponding rotational alignment of the insert unit 8 relative to the caster body or vice versa before the pressing-in of the insert unit. Problems of the sealing would not arise, since as with the mode of construction illustrated in FIG. 2 an unobjectionable sealing between the circumferential flange 22 and the opening edge 9 of the caster is obtained by the downwardly effective component of the latching force produced by the cooperation of lip 18 and groove 20, through which the flange 22 is urged tightly against the opening edge 9 of the caster body.

As is still further evident in FIG. 2, the dimensions of the flange 22 and the downwardly bent rim extension 23 connected to it, with the lip 18 provided at the internal circumference of the rim 23, as well as the external groove 20, are chosen and adapted to one another in such a manner, that on the lip 18 having been latched into the external groove 20, the outer diameter of the downwardly bent extension 23 is smaller or at most equal to the smallest diameter of the region 3 of the caster body, which is indicated by the dot-dashed line 24. In the form of embodiment illustrated in FIG. 2, in which a projecting thread element 4 for cooperation with a correspondingly shaped thread element of the lid 5 is provided externally at the circumference of the cylindrical region 3 of the caster, the smallest external diameter 24 of the caster in the cylindrical region is determined by the depth of the external thread. It is immediately evident, that the lid 5 with omission of the raised thread projections 4 could thus also be formed as a simple superimposed or push-on lid, the internal diameter of which is about equal to the smallest external diameter 24 of the caster in the cylindrical region 3 without an extension 23 interfering with the putting-on or taking-off of the lid 5.

In FIG. 3 parts of which are similar to those in FIGS. 1 and 2 are designated by the same reference characters with an added prime. In the construction according to FIG. 3, the resilient latching connection between the insert unit 8' and the cylindrical region 3' of the caster body is attained as follows. At the outer circumference of the insert unit 8', and thus at the cylindrical wall 11' thereof, there is provided an outwardly projecting bead 19, which cooperates with recess means in the form of an internal fillet 21 provided underneath the opening edge 9' of the caster wall 3'. As is evident, the bead 19 and the internal fillet 21 are also here so adapted to one another in their shaping, so that only a relatively small pressure is required for pressing-in and engaging the insert part 8' to bring this part into the bore 7' or to extract it therefrom when desired. To prevent a complete pressing-in of the insert part 8', there is provided at the upper rim thereof an outwardly extending radial flange 22' which, as shown in FIG. 3 is accommodated in a depression 25 at the edge 9' of the opening in the caster body and which has an upper surface contiguous with the edge 9'.

In the embodiment according to FIG. 3, the bead 19 at the insert 8' and the internal fillet 21 in the cylindrical region 3 of the caster body are preferably executed as circumferentially continuous circular parts, because here, in contrast to FIG. 2, the sealing of the interior of the caster against the leaking out of the material in the caster outside of the insert unit 8' must be prevented by the cooperation of the resilient bead 19 with the internal fillet 21. With an only sectionwise formation of the bead 19, the attained sealing function, here provided by the cooperation of bead 19 and internal fillet 21, would no longer be unobjectionably secured.

The lid 5', in an unillustrated embodiment ohterwise similar to that shown in FIG. 3 but with the thread projections 4' omitted, may be formed as a simple superimposition or push-on lid instead of being of the illustrated rotary screw type. The internal diameter of such a push-on lid is such that it corresponds approximately to the smallest external diameter 24' of the caster in the cylindrical region 3'. The embodiment illustrated in FIG. 3 is particularly suitable where the cylindrical region 3' of the caster body has only a relatively small wall thickness.

Due to the formation and retention of the insert unit 8 in the cylindrical region 3 of the caster body, the internal diameter of the bore 7 in the cylindrical region 3 of the caster and the external diameter 26 of the insert unit 8 need not be machted accurately to one another, but can vary from one another over a relatively wide range, provided that the largest internal diameter 7 exceeds the external diameter 26 of the insert unit 8.

Although in the preferred embodiments of the invention which have been described above, the caster body consists of glass and the insert unit consists of synthetic material, the invention is also applicable to caster bodies of any suitable material other than glass, such as, for example, ceramics or porcelain. The invention is also applicable to casters in which not only the insert unit 8, but also the caster body consists of synthetic material.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. A caster for pulverulent, granular or lumpy substances such as spices, the caster comprising in combination:

a hollow body defining a storage chamber and at an outlet end thereof having a generally cylindrical wall portion defining a cavity of circular cross-sections;

recess means provided in said generally cylindrical wall portion to at least partially encompass said cavity;

a cap insert made of synthetic material and comprising a resilient portion latchably engaging said recess means to retain said cap insert on said body, a hollow cylindrical portion of said cap insert having an external diameter slightly smaller than the diameter of said cylindrical portion so that a clearance is present between them and being received in said cavity, and a perforate plate portion extending at said outlet across the interior of said hollow cylindrical portion and being perforate in at least one of a plurality of spaced regions thereof;

a cover slide carried by said cap insert and rotatably mounted in the interior of said hollow cylindrical portion thereof, said cover slide comprising a plate portion having an aperture therein and slidably contacting said perforate plate portion of said cap insert, and a collar portion having wall members each extending substantially perpendicularly of said apertured plate portion to define therebetween a passage communicating with said aperture in said apertured plate portion; and a lid member adapted to be detachably mounted to said generally cylindrical wall portion of said hollow body to extend across said cavity and having an internal surface which, when said lid member is mounted on said body, is adapted to contact both said cap insert and end faces of said wall members remote from said apertured plate portion.

2. A caster as defined in claim 1, wherein at least two regions of said perforate plate portion are provided with respective different sets of said perforations.

3. A caster as defined in claim 1, wherein said recess means is provided in an inward facing surface of said generally cylindrical wall portion and said resilient portion of said cap insert comprises a bead on an outward facing surface of said cap insert.

4. A caster as defined in claim 3, wherein said recess means extends continuously around said inward facing surface of said generally cylindrical wall portion of said body, and said bead extends continuously around said outward facing surface of said hollow cylindrical portion of said cap insert.

5. A caster as defined in claim 1, wherein said cap insert comprises a radially extending flange to contact a rim portion of said generally cylindrical wall portion of said body, said flange being provided at the periphery thereof with a cylindrical wall portion having a resilient lip portion projecting radially inwardly thereof to latchably engage an external groove provided in said generally cylindrical wall portion of said body in proximity of said rim portion thereby to retain said cap insert on said hollow body.

6. A caster as defined in claim 5, wherein when said lip portion is fully engaged in said groove, the external diameter of said cylindrical wall portion of said flange is at most equal to the external diameter of said generally cylindrical wall portion of said body.

7. A caster as defined in claim 5, wherein said generally cylindrical wall portion of said body is provided with an external screw thread adapted to cooperate with an internal thread provided on said lid member, the external diameter of said cylindrical wall portion of said flange, when said lip portion is fully engaged in said groove, being at most equal to the diameter of parts of said generally cylindrical wall portion of said body which define root portions of said external screw thread.

* * * * *